US007275733B2

(12) United States Patent
Svitavsky et al.

(10) Patent No.: US 7,275,733 B2
(45) Date of Patent: Oct. 2, 2007

(54) COMPACT DRIVE FOR A COUNTERWEIGHT ASSISTED WINCH

(75) Inventors: Peter V. Svitavsky, Port Byron, NY (US); Steven J. Kochan, Skaneateles, NY (US); Donald P. Ardine, Baldwinsville, NY (US)

(73) Assignee: J.R. Clancy, Inc., Syracuse, NY (US)

( * ) Notice: Subject to any disclaimer, the term of this patent is extended or adjusted under 35 U.S.C. 154(b) by 0 days.

(21) Appl. No.: 11/532,975

(22) Filed: Sep. 19, 2006

(65) Prior Publication Data

US 2007/0045600 A1 Mar. 1, 2007

Related U.S. Application Data

(63) Continuation-in-part of application No. 11/162,431, filed on Sep. 9, 2005, now Pat. No. 7,264,228.

(51) Int. Cl.
*B66D 1/26* (2006.01)

(52) U.S. Cl. ..... 254/278; 254/358; 254/372; 254/394

(58) Field of Classification Search ..... 254/338, 254/358, 372, 390, 393, 394, 278, 290, 397
See application file for complete search history.

(56) References Cited

U.S. PATENT DOCUMENTS

| | | | | |
|---|---|---|---|---|
| 2,649,279 | A * | 8/1953 | Jones et al. | 254/329 |
| 3,917,230 | A * | 11/1975 | Barron | 254/270 |
| 4,183,649 | A * | 1/1980 | Hartley | 254/279 |
| 6,209,852 | B1 * | 4/2001 | George et al. | 254/372 |
| 6,651,961 | B1 * | 11/2003 | Meyer | 254/337 |
| 7,246,712 | B2 * | 7/2007 | Baker | 212/78 |

* cited by examiner

*Primary Examiner*—Emmanuel M Marcelo
(74) *Attorney, Agent, or Firm*—George R. McGuire; David L. Nocilly; Bond, Schoeneck & King, PLLC

(57) ABSTRACT

The invention is a compact drive for a counterweight-assisted winch which can be retrofitted into existing manually operated systems that use counterbalancing weights. The counterbalancing weight will be fixed at a first predetermined percentage of the maximum capacity of the set, preferably about 50%. The winch is rated at a second predetermined percentage of the maximum capacity of the set, preferably about 50%. Together the first and second predetermined percentages sum to at least 100% of the maximum capacity of the set. By using the winch in a closed loop configuration, it will operate the set at any load from 0 to 100% of the set's rated capacity, without the need to adjust the counterbalancing weights. The compact drive system employs two motorized winches positioned along the long axis of two adjacent counterweight rigging systems, each winch engaging a respective chain used to move a counterbalancing weight.

5 Claims, 6 Drawing Sheets

COMPACT DRIVE FOR A COUNTERWEIGHT ASSISTED WINCH

PRIORITY CLAIM

This application claims priority to U.S. Utility patent application Ser. No. 11/162,431, filed Sep. 9, 2005 now U.S. Pat. No. 7,264,228.

BACKGROUND OF THE INVENTION

The present invention relates generally to theatrical rigging systems, and more particularly to rigging systems that utilize counterweights to raise and lower the load.

Most existing rigging systems use manually operated rigging sets (or "sets"), which are counterbalanced with weights for ease of operation. When loads (scenery, curtains, lighting equipment, etc.) are changed, the counterbalancing weights must be adjusted to properly balance the load. This normally happens when the load is at floor level and counterbalancing weights are substantially above the floor, making access difficult.

In their most basic form, conventional rigging sets, such as the one illustrated in FIG. 1 and designated generally by reference numeral 10, comprise a locking rail 12 fixed to the floor, a tensioning floor block 14 around which a control line 16 passes, a counterweight arbor 18 the opposing sides to which opposite ends of the control line 16 attach, a head block 20 around which control line 16 passes and which gather lift lines 22 that otherwise extend between arbor 18 and a batten 26 to which the load is attached. To raise and lower batten 26, counterweights must be removed from or added to arbor 18. This requires the rigging operator to manually remove or place weights onto arbor 18 generally at a relatively significant height.

In addition, it is necessary to ensure that a rope lock 28 is engaged to prevent sudden movement of the control line and counterweights when the operator balances the load with the counterweights. If the rope lock 28 fails or is not engaged in the first place, the arbor will rise or fall at significant speed, very likely causing serious injury and perhaps killing the operator. In addition, the amount of weight to balance the load must be carefully selected to ensure that the load is within the strength capability of the operator. Failure to do so can cause injury or death to the operator and the people on the stage below the load.

Many of these rigging systems are used in middle school and high school theatres. There are concerns about the ability of the operators (frequently students) to properly balance the loads, and the requirement for the balancing work to be done at substantial heights.

Because of the compact nature of typical counterweight rigging installations, a counterweight rigging system using a motorized winch requires a motorized winch sized to fit in a space approximately equal to the center-center spacing between adjacent rigging systems. Motorized winches of that size and also having sufficient power to operate a counterweight-assisted rigging system are expensive or have other characteristics that make them unsuitable for theatrical installations. Economical motorized winches having sufficient power to operate a typical counterweight-assisted system generally are larger than the spacing between adjacent counterweight rigging system.

SUMMARY OF THE INVENTION

One aspect of the invention contemplates a counterweight-balanced rigging system for raising and lowering a load of predetermined weight, comprising a winch having a rating of at least one half the predetermined weight; an arbor having counterweights positioned thereon, wherein the weight of the counterweights is about one half of the predetermined weight; a first control line interconnecting the arbor to the load; and a second control line interconnected between the arbor and the first control line and positioned in movingly and lockingly engaged relation to the winch.

By eliminating the need to adjust counterbalancing weights on a regular basis, operational safety and convenience are improved.

In addition to being used as a retrofit device, this device can be used in new installations in conjunction with a fixed counterweight set.

By providing a compact drive for a counterweight-assisted winch, which is sized to fit within the space that remains after selected components of a counterweight rigging system are removed, it is possible to install a plurality of adjacent counterweight assisted rigging systems in a compact space.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
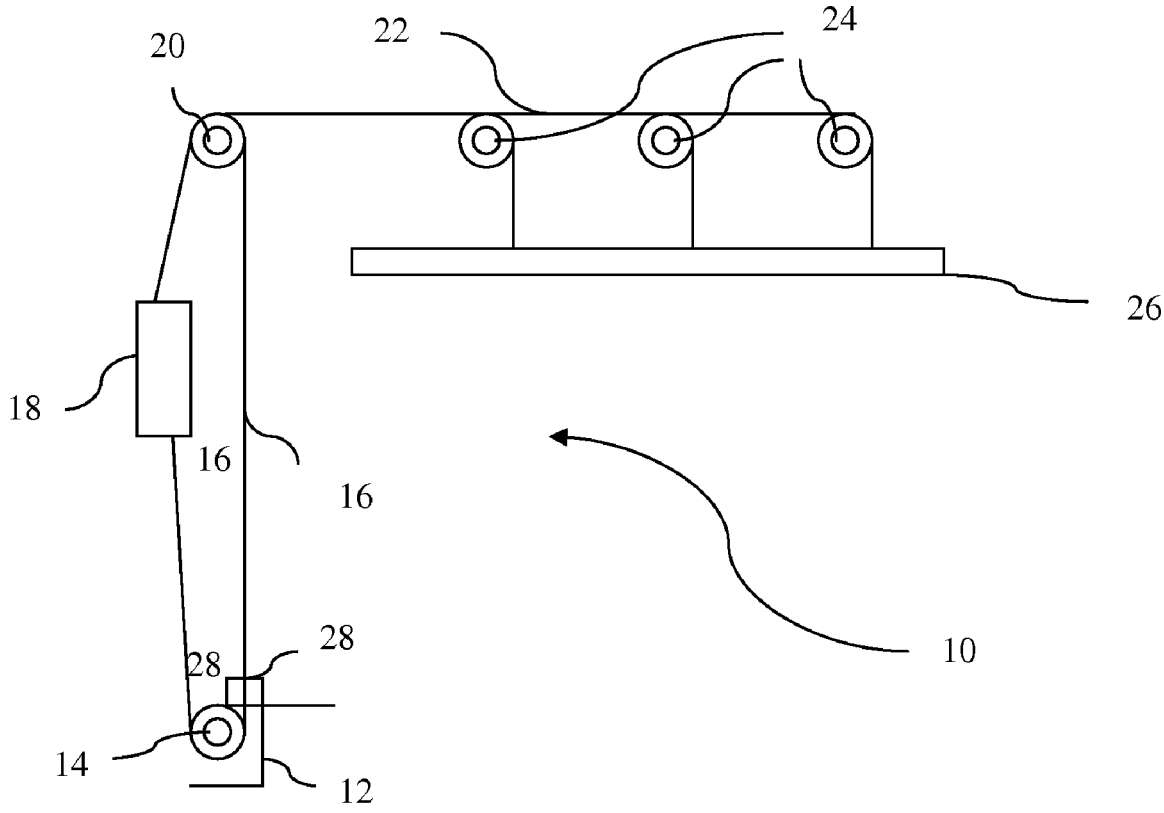
Figure 1 Prior Art
FIG. 1 is an elevation view of a prior art counterweight rigging system.
Figure 2:
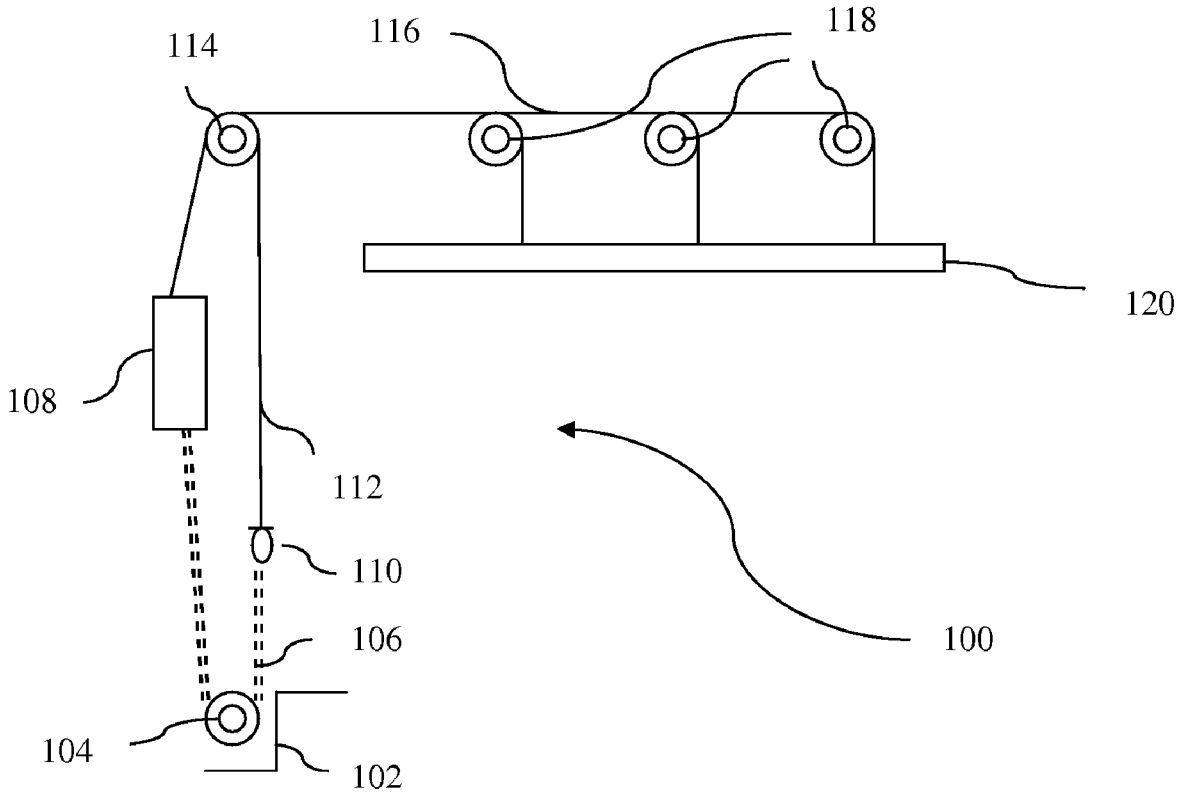
FIG. 2 is an elevation view of a counterweight rigging system in accordance with a preferred embodiment of the present invention.

Referring now to the drawings, wherein like reference numerals refer to like parts throughout, there is seen in FIG. 2 a counterweight rigging system, designated generally by reference numeral 100, essentially comprising a locking rail 102 anchored to the floor or other fixture/building structure, a winch 104 positioned on rail 102, a drive chain 106 that extends between a counterweight arbor 108 and a junction point 110 on the opposite side of winch 104, a rope 112 that extends between junction point 110 around a head block 114 and down to the opposite side of arbor 108 as drive chain 106. Rope 112 can be a variety of moderately flexible linear materials, such as natural fiber rope, synthetic fiber rope, cable or other similar materials, provided it is the same diameter as control line 16 (FIG. 1). System 100 further comprises conventional lift lines 116 that extend from arbor 108 and around head block 114 and loft blocks 118 and then down to a batten 120 to which a load (such as scenery, lighting, curtains, sound equipment, and the like) is attached. In a typical installation a plurality of counterweight rigging systems is installed in parallel fashion to allow the raising and lowering of a plurality of battens 120. Normally, such systems are installed compactly, with approximately six to eight inches between adjacent systems.

The present invention substitutes drive chain 106 and motor driven winch 104 for conventional control line 16, rope lock 28 and tensioning floor block 14. In addition, arbor 108 is loaded with a predetermined amount of weight equal to a portion (preferably, approximately 50%) of the counter weight system capacity. The predetermined weight is fixed and does not need to be adjusted after it is installed. Winch 104 is preferably rated at a portion of the counterweight system capacity such that the predetermined weight and the winch capacity collectively are at least equal to the counterweight system's capacity. The winch rating can be any amount up to 100% of the counterweight system rated capacity. Therefore, if batten 120 (and hence the load) needs to be raised or lowered, winch 104, in conjunction with the fixed counterweight, raise and lower a load anywhere between 0% to 100% of the counterweight system rated capacity without having to increase or decrease the amount of counterweights loaded on arbor 108.

Figure 3A:
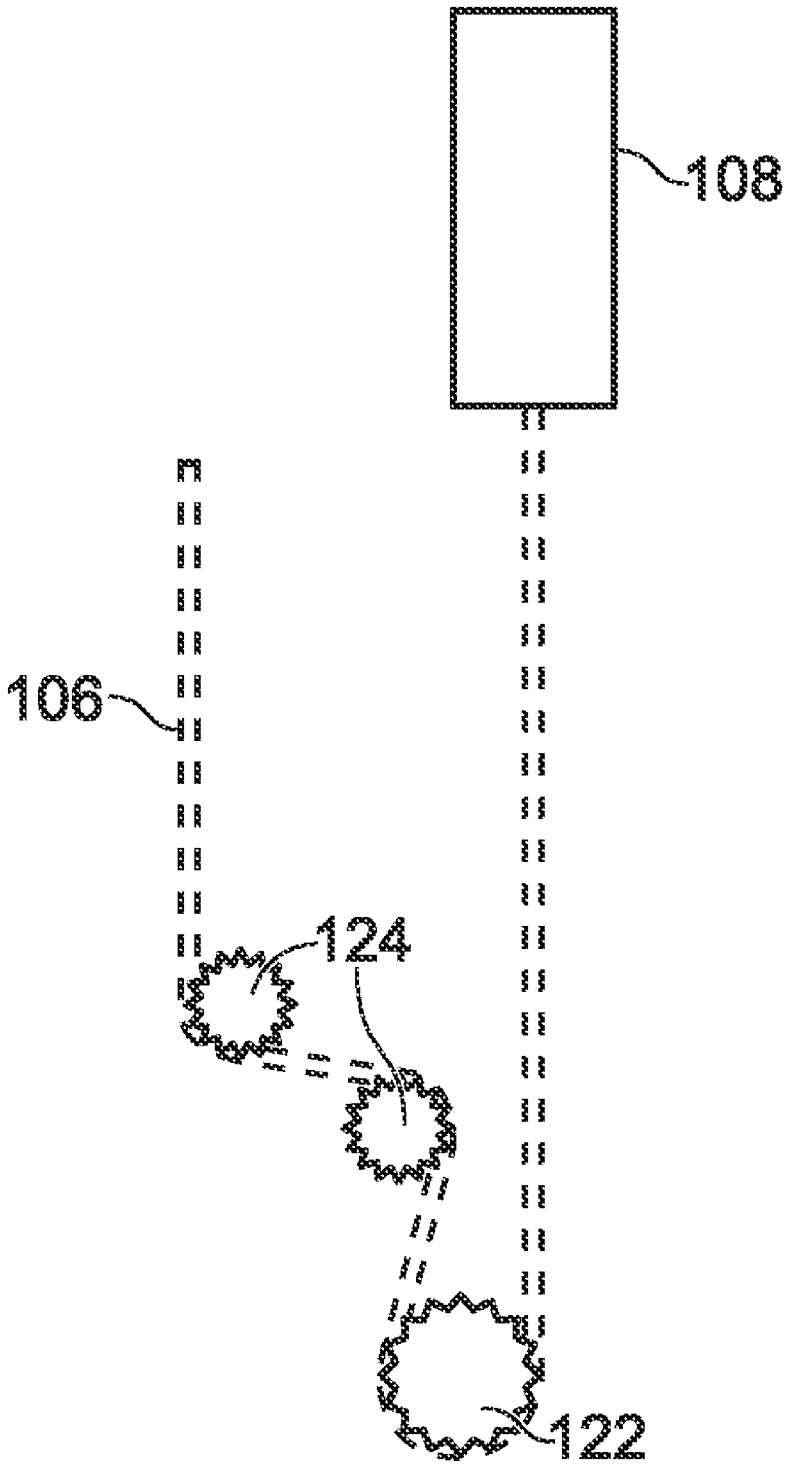
FIG. 3A is a detailed elevation view of the drive chain and winch portions of the present invention.
Figure 3B:
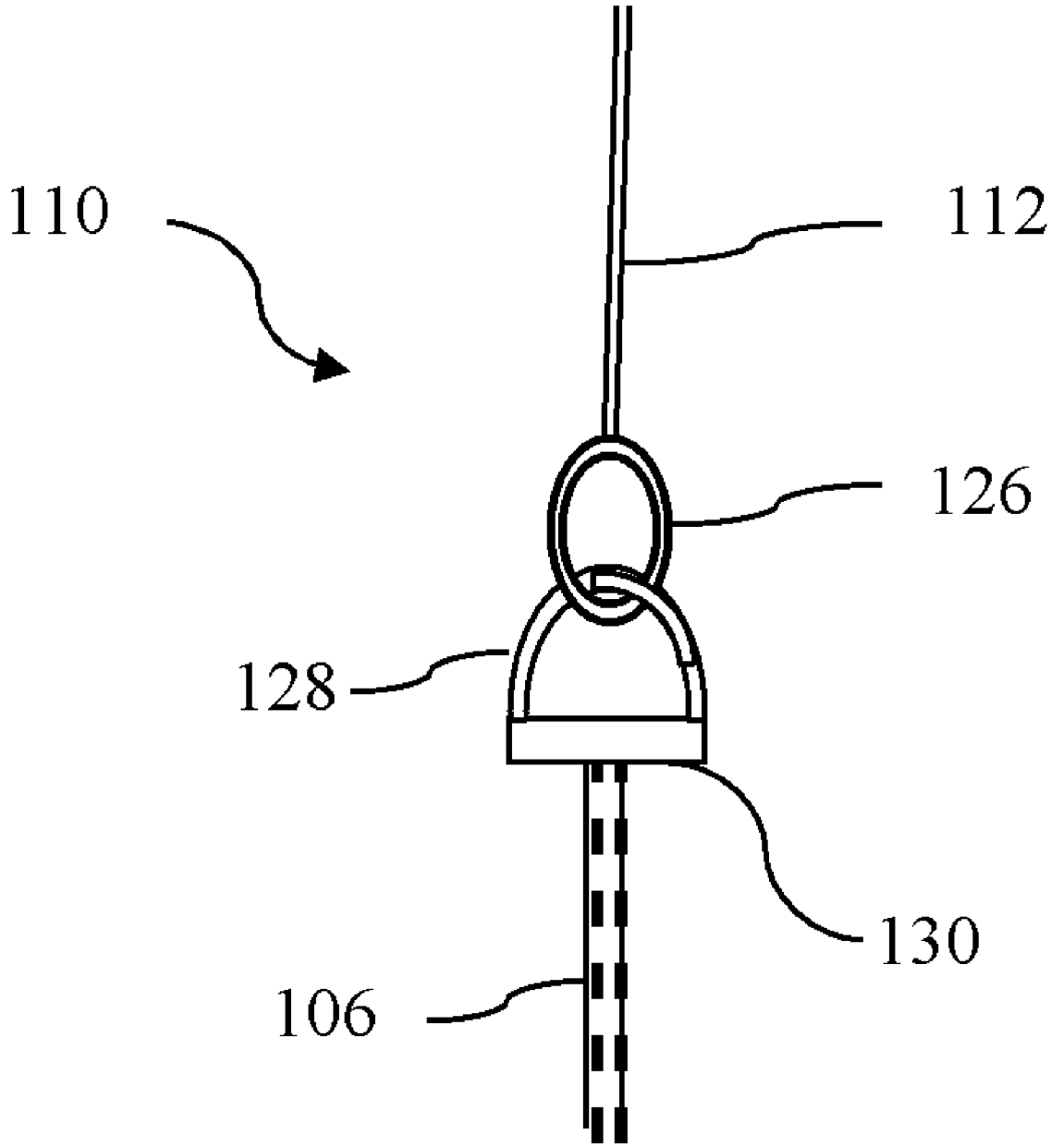
FIG. 3B is an enlarged elevation view of the junction point between the drive chain and rope.

With reference to FIG. 3A, drive chain 106 is fixed at one end to the bottom of arbor 108, extends around a drive sprocket 122 within winch 104, around idler sprockets 124 which redirect its orientation to run parallel with that portion extending outwardly from arbor 108, and terminates at junction point 110. Junction point 110 comprises any conventional fastening mechanism, such as an eye 126 to which rope 112 attaches, and a shackle 128 with a pin 130 passing through the last link of drive chain 106 fixing it to the shackle, as shown in FIG. 3B. Other conventional fastening systems for interconnecting two lines could work as well.

The motorized winch 104 could be located at any point along the drive chain 106, although it is preferred that it be located at or near the floor. Other positioning locations are, however, possible and well known to those skilled in the art.

In addition to the first embodiment disclosed herein, there are several other different approaches to how the winch drives the control line.

For example, on existing systems the control line (collectively, the drive chain 106 and rope 112 in the preferred embodiment) is a manila or synthetic rope, typically ¾" diameter. A winch that could engage the rope in a manner that would provide a positive drive (no slipping) could be implemented using serpentine rollers or similar structure.

Alternatively, the control line could be replaced entirely with a roller chain, or other flexible medium with the ability to be positively driven. The challenge with this approach is that the head block and floor block of existing systems typically have grooves to accommodate ¾" diameter rope. Replacing the head block is labor intensive and expensive.

The motorized winch 104 would include a motor, gear reducer, mechanism to drive the control line (serpentine rollers, sprocket wheel, etc.), a limit switch to control the limits of travel, a starter or variable speed drive, and a control system. The control system could be simple Up/Down pushbuttons or one of the programmable position controllers developed for use with the PowerLift™ rigging system manufactured and sold by J. R. Clancy, Inc. of Syracuse, N.Y. Other sensing and safety devices could be added.

To ensure the winch/system are not overloaded a method of ensuring weight cannot be added to or taken from the arbor must be included. The weights could be banded in place with steel strapping tape, and a filler installed on top of the weights to prevent the addition of more weights.

Figure 4A:
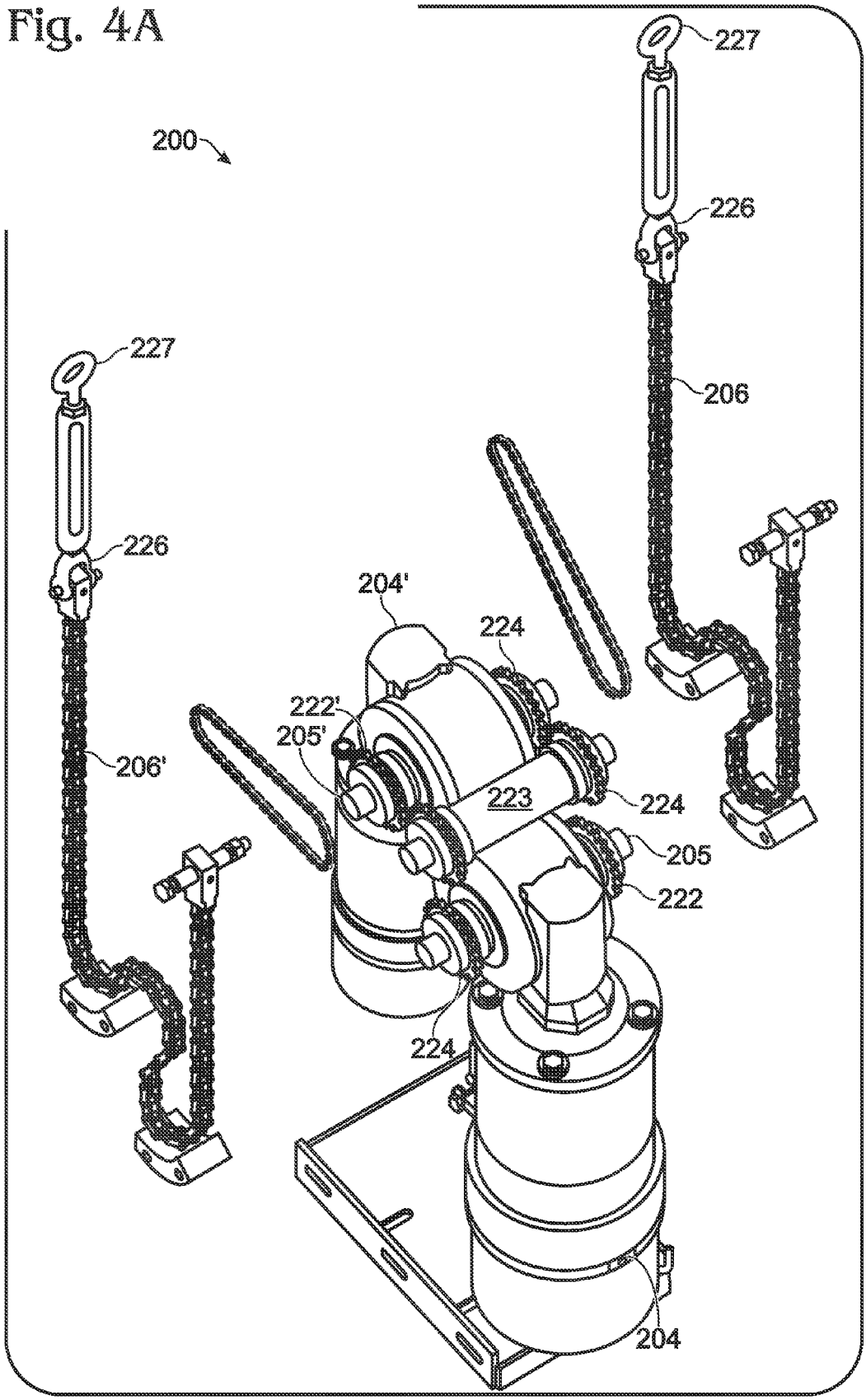
FIG. 4A is an exploded perspective view of an embodiment of the invention.
Figure 4B:
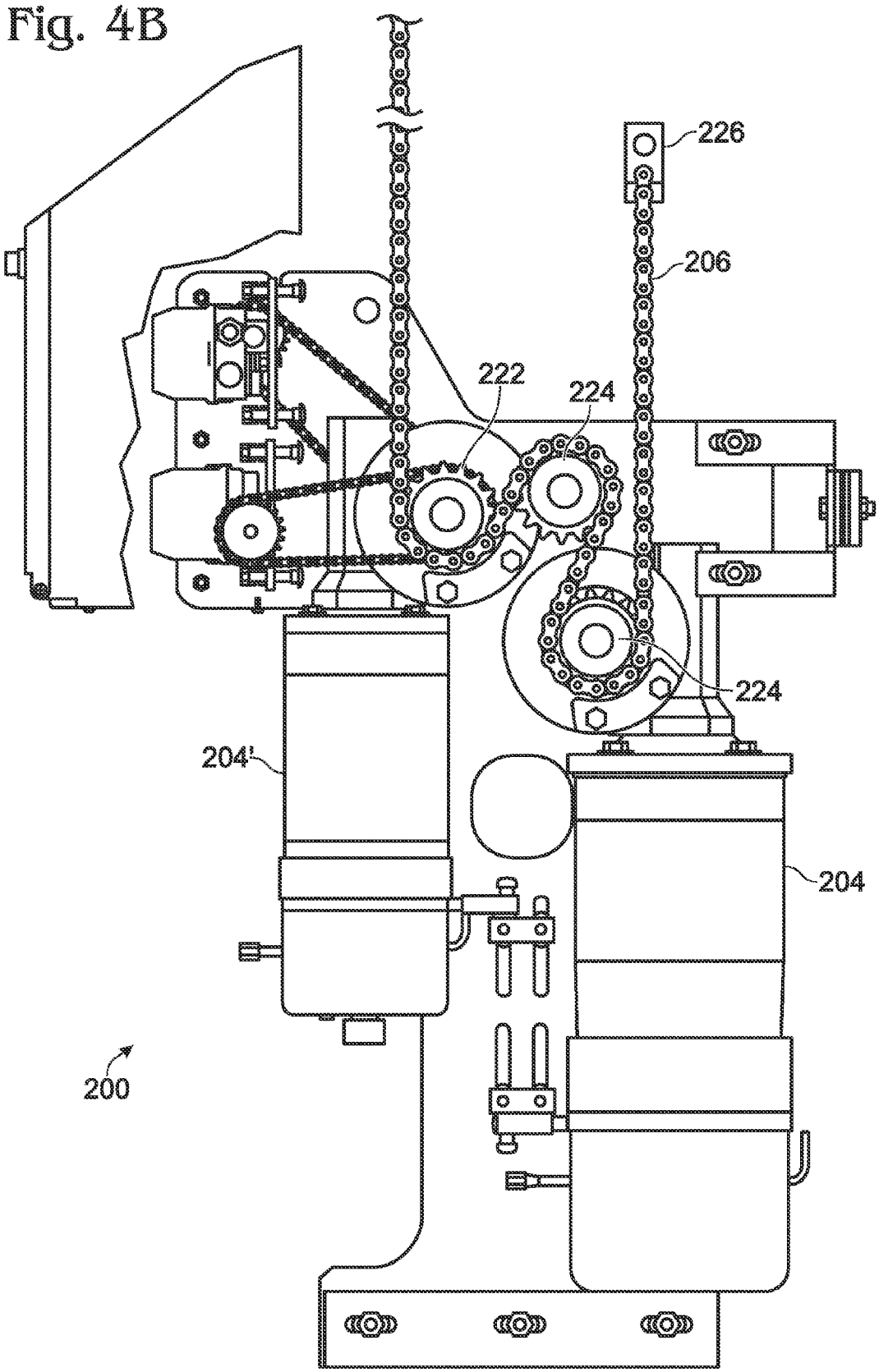
FIG. 4B is a partial side elevation view of an embodiment of the invention.

Referring now to FIGS. 4A and 4B, a compact drive 200 according to the present invention comprises a first motorized winch 204, a first driven axle, a second motorized winch 204', a second driven axle and an idler assembly 223. The idler assembly 223 comprises an axle with an independently rotating idler gear 224 at each end. Each driven axle includes a driven gear 222, 222' and an idler gear 224. Each idler gear 224 rotates freely on its respective driven axle and rotates independently with respect to its respective driven gear 222, 222' and motorized winch 204, 204'. The two motorized winches 204, 204' of the compact drive 200 are sized to fit within the space allocated to two adjacent counterweight rigging systems (i.e., twice the center-to-center spacing of the plurality of counterweight rigging systems). In particular, the two motorized winches 204, 204' of the compact drive 200 are laterally spaced so that their collective width is no greater than that of a single motorized winch of the same capacity.

Drive chain 206 for a first counterweight-assisted system passes around the driven gear 222 of first motorized winch 204, around the idler gear 224 of the idler assembly 223 and around the idler gear 224 of the second motorized winch 204'. Drive chain 206' for a second counterweight-assisted system passes around the driven gear 222' of second motorized winch 204', around the idler gear 224 of the idler assembly 223 and around the idler gear 224 of the first motorized winch 204. In this way, first motorized winch 204 drives chain 206 and second motorized winch 204' drives chain 206'. Interposition of the idler assembly 223 between one winch's driven gear 222, 222' and the other winch's idler gear 224 increases the portion of the driven gear 222, 222' that engages the drive chain 206, 206', which increases the strength of the engagement and assists in transmission of power to the drive chain 206, 206'. Routing drive chain 206, 206' around the additional idler gears 224 ensures that the drive chain 206, 206' enters and leaves the compact drive 200 in parallel and generally vertical paths, laterally separated by a distance approximately equal to the diameter of head block 114 (FIG. 2).

According to one embodiment, drive chains 206, 206' are connected to a fastening mechanism 227 by connecting link 226. Fastening mechanism 227 is then connected to a control line as previously disclosed.

What is claimed is:

1. A compact drive for a counterweight balanced rigging system for raising and lowering a first load of a first predetermined maximum weight and a second load of second predetermined maximum weight, comprising:

a first winch having a rating of at least one half the first predetermined weight, connected to an axle having a driven gear and an idler gear;

a second winch having a rating of at least one half the second predetermined weight, connected to an axle having a driven gear and an idler gear;

a first arbor having counterweights positioned thereon, wherein the weight of the counterweights is about one half of the first predetermined maximum weight;

a second arbor having counterweights positioned thereon, wherein the weight of the counterweights is about one half of the second predetermined maximum weight;

a first lift line interconnecting said first arbor to the first load;

a second lift line interconnecting said second arbor to the second load;

a first control line connected to said first arbor and positioned in movingly and lockingly engaged relation to said first winch's driven gear and said second winch's idler gear;

a second control line connected to said second arbor and positioned in movingly and lockingly engaged relation to said second winch's driven gear and said first winch's idler gear.

2. The system of claim 1, further comprising an idler assembly having a first idler gear and a second idler gear, wherein said first control line is positioned in movingly and lockingly engaged relation to said idler assembly's first idler gear and said second control line is positioned in movingly and lockingly engaged relation to said idler assembly's second idler gear.

3. The system of claim 1, wherein one of said first control line and said second control line comprises a drive chain.

4. A compact drive for a counterweight balanced rigging system for raising and lowering loads partially balanced by fixed weights on a first counterweight arbor and a second counterweight arbor, the rigging system including a first drive chain for moving the first counterweight arbor, a second drive chain for moving the second counterweight arbor, the compact drive comprising:

a first winch operatively connected to an axle having a first driven gear and a first idler gear;

a second winch operatively connected to an axle having a second driven gear and a second idler gear;

wherein said first drive chain moves in a first plane, engages said second idler gear and is operatively engaged by said first driven gear;

wherein said second drive chain moves in a second plane, engages said first idler gear and is operatively engaged by said second driven gear;

wherein said first plane and said second plane are generally parallel; and wherein said first winch is laterally spaced from said second winch along an axis that is generally parallel to said first and second planes.

5. The compact drive of claim 4, further comprising an idler assembly having a third idler gear and a fourth idler gear, said third idler gear engaging said first drive chain intermediate said first driven gear and said second idler gear and said fourth idler gear engaging said second drive chain intermediate said second driven gear and said first idler gear.

* * * * *